United States Patent [19]

Brier

[11] Patent Number: 4,841,743

[45] Date of Patent: Jun. 27, 1989

[54] CONTAINER WITH INTEGRAL COOLING MEANS

[76] Inventor: John J. Brier, Beta Theta Pi, College Ave., Orono, Me. 04469

[21] Appl. No.: 1,525

[22] Filed: Jan. 8, 1987

[51] Int. Cl.[4] ..... F25D 3/08

[52] U.S. Cl. ..... 62/457.9; 62/530

[58] Field of Search ..... 62/457, 371, 372, 529, 62/530, 430, 438

[56] References Cited

U.S. PATENT DOCUMENTS

| | | | |
|---|---|---|---|
| 2,174,455 | 9/1939 | Bates | 62/530 |
| 2,211,636 | 8/1940 | Bates | 62/530 |
| 2,526,165 | 10/1950 | Smith | 62/457 |
| 2,595,328 | 5/1952 | Bowen | 62/530 |
| 2,622,415 | 12/1952 | Landers et al. | 62/430 X |
| 2,697,424 | 12/1954 | Hanna | 62/530 X |
| 2,964,920 | 12/1960 | Staebler | 62/1 X |
| 3,262,283 | 7/1966 | Taylor | 62/457 X |
| 3,413,820 | 12/1968 | Paquin | 62/430 X |
| 3,885,403 | 5/1975 | Spencer | 62/530 |
| 4,311,022 | 1/1982 | Hall | 62/530 X |

*Primary Examiner*—Lloyd L. King
*Attorney, Agent, or Firm*—Leon Gilden

[57] ABSTRACT

A container for keeping food chilled includes an integral sealed cooling fluid. The cooling fluid may be precooled in a freezer so as to maintain the food in the container in a chilled state upon a removal of the container from the freezer. Each container is manufactured from a flexible plastic bag or the like which allows an expansion of the container walls when the retained fluid is frozen. A rigid frame structure is positioned within the flexible bag to maintain the container shape. Various portions of the rigid frame structure are separated so as to facilitate container expansion during the freezing process.

5 Claims, 3 Drawing Sheets

CONTAINER WITH INTEGRAL COOLING MEANS

BACKGROUND OF THE INVENTION

1. Field of the Invention

The present invention is directed to cooling containers for beverages and other foods, and more particularly pertains to double-wall containers which hold a quantity of chillable or freezable fluid that can be cooled or frozen without damage to the container.

2. Description of the Prior Art

The use of double-wall containers for keeping beverages and other foods cold is well known in the prior art. In this respect, reference is made to U.S. Pat. No. 4,520,633, to R. Hoydic on June 4, 1985. The Hoydic apparatus comprises a bowl for keeping food chilled which is separable into two parts to include an upper food-containing receptacle and a lower ice-containing chamber. Inasmuch as the two bowl sections are slidably attached together, slidable relative movement therebetween is afforded during a freezing of the ice in the lower container. In this respect, it is well known that the freezing of virtually any fluid from its liquid state into a frozen solid state results in an expansion of its overall volume If means are not provided for an expansion of the retainer in which the fluid is contained, the container is subject to damage and rupture.

U. S. Pat. No. 4,485,636, which issued to R. Hilado on Dec. 4, 1984, also recognizes the necessity of providing room for expansion of an enclosed refrigerant. More particularly, the Hilado device comprises a container of a double-wall structure, with such wall structure forming a refrigerant cavity for holding a fluid which, when frozen, produces a cooling of a beverage or food in the container. A stress-relieving diaphragm accommodates the expansion of the fluid upon a chilling thereof so as to prevent breakage of the container. While the Hilado container is functional for its intended purpose, reference to the drawings enclosed with this patent will disclose the fact that it is of a substantially complex design. Inasmuch as complexities of design cause a concurrent increase in the expense of manufacture, the Hilado container has apparently not met with commercial success.

As such, there appears to be a continuing need for new and improved double-walled containers which can hold a refrigerant wherein such containers may be inexpensively and easily manufactured, and in this respect, the present invention substantially fulfills this need.

SUMMARY OF THE INVENTION

In view of the foregoing disadvantages inherent in the known types of double-wall refrigerant holding containers now present in the prior art, the present invention provides an improved double-wall refrigerant holding container wherein the same can be inexpensively and easily manufactured, and can provide for the freezing of the enclosed refrigerant without damage to the container walls. As such, the general purpose of the present invention, which will be described subsequently in greater detail, is to provide a new and improved double-wall refrigerant holding container which has all the advantages of the prior art double-wall refrigerant holding containers and none of the disadvantages.

To attain this, the present invention comprises a container formed from a flexible expandable material,such as plastic, rubber, or the like. A refrigerant cavity is formed in the walls and bottom portion of the container, with the refrigerant being permanently sealed therein. Typically, such refrigerant would comprise a gel, such as the commercially available "24 Hour Ice" now sold to consumers, so that a container could retain its chilling effect for substantially a complete day. Thus, the need for ice in an ice chest is eliminated when a plurality of these containers are used to store food therein.

Inasmuch as the containers are formed from a flexible expandable plastic material, it can be appreciated that some difficulty would be encountered in causing the containers to retain their food holding shape. To overcome this difficultly, the present invention includes an enclosed movable rigid frame structure captured within the refrigerant cavity. In this respect, the frame structure includes bottom and top rigid edge or rim portions, and a plurality of upstanding supports are then directed between the bottom and top rim members. The upstanding supports prevent the top rim member from collapsing onto the bottom rim member, thereby to maintain the container in its fluid holding shape, with these upstanding members being relatively movable with respect to the top and bottom rim members. This is accomplished by providing small flexible tabs between the upstanding members and the top and bottom rim members, with the entire rigid frame structure being formed of plastic in a single molding process. As such, the container is allowed to expand in all directions during a freezing of the enclosed refrigerant, with the rigid frame structure then being floatably movable within the refrigerant cavity.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved double-wall refrigerant holding container which has all the advantages of the prior art double-wall refrigerant holding containers and none of the disadvantages.

It is another object of the present invention to provide a new and improved double-wall refrigerant holding container which may be easily and efficiently manufactured and marketed.

It is a further object of the present invention to provide a new and improved double-wall refrigerant holding container which is of a durable and reliable construction.

An even further object of the present invention is to provide a new and improved double-wall refrigerant holding container which is susceptible of a low cost of manufacture with regard to both materials and labor, and which accordingly is then susceptible of low prices of sale to the consuming public, thereby making such double-wall refrigerant holding containers economically available to the buying public.

Still yet another object of the present invention is to provide a new and improved double-wall refrigerant holding container which provides in the apparatuses and methods of the prior art some of the advantages thereof, while simultaneously overcoming some of the disadvantages normally associated therewith.

Still another object of the present invention is to provide a new and improved double-wall refrigerant holding container which maintains its food holding shape while being expandable to accommodate the freezing of its refrigerant.

Yet another object of the present invention is to provide a new and improved double-wall refrigerant holding container which includes the use of a permanently retained and sealed refrigerant within its wall structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
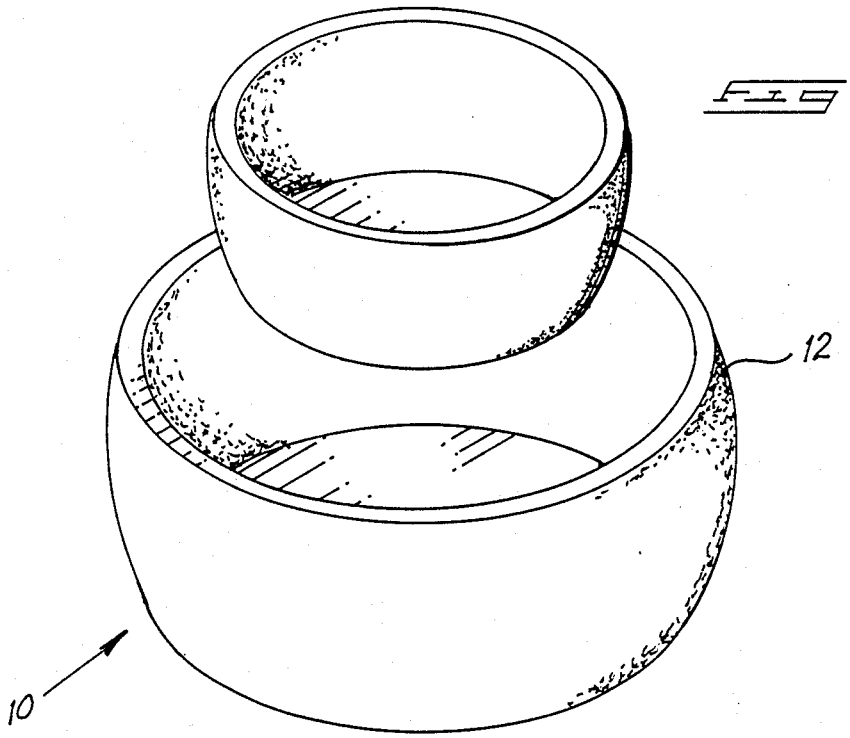
FIG. 1 is a perspective view of a plurality of the double-wall refrigerant holding containers comprising the present invention.

With reference now to the drawings, and in particular to FIGS. 1, 2, 3 and 4 thereof, a new and improved double-wall refrigerant holding container embodying the principles and concepts of the present invention and generally designated by the reference numeral 10 will be described.

Figure 2:
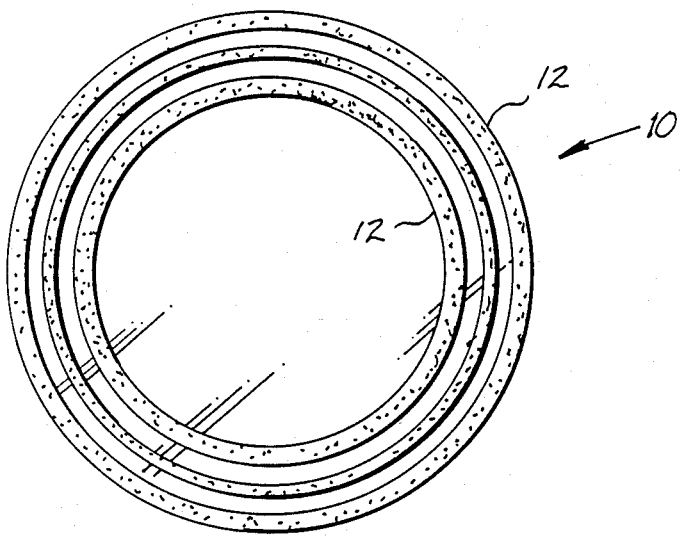
FIG. 2 is a top plan view of the containers showing them in a nested relationship.
Figure 3:
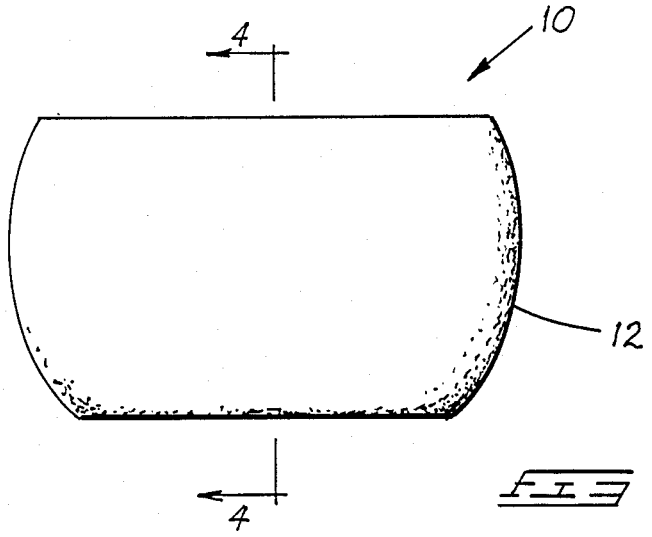
FIG. 3 is a side elevation view of a container.
Figure 4:
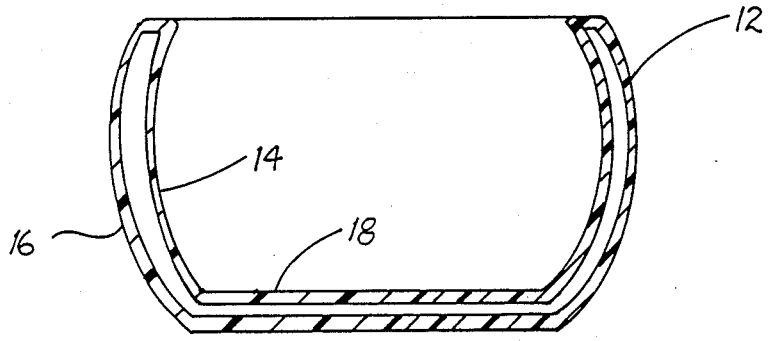
FIG. 4 is a cross-sectional view taken along the line 4—4 in FIG. 3.

More specifically, it will be noted that the double-wall refrigerant holding container 10 essentially comprises a bowl 12 which may be varied in shape and design to include a nestable construction as illustrated in FIG. 2. Each bowl 12 includes an inner wall 14 and an outer wall 16 integrally attached together, with a fluid filled chamber 18 being defined between the walls. As above discussed, the fluid holding chamber 18 may be filled with a refrigerant, such as a chillable or freezable jell.

Figure 5:
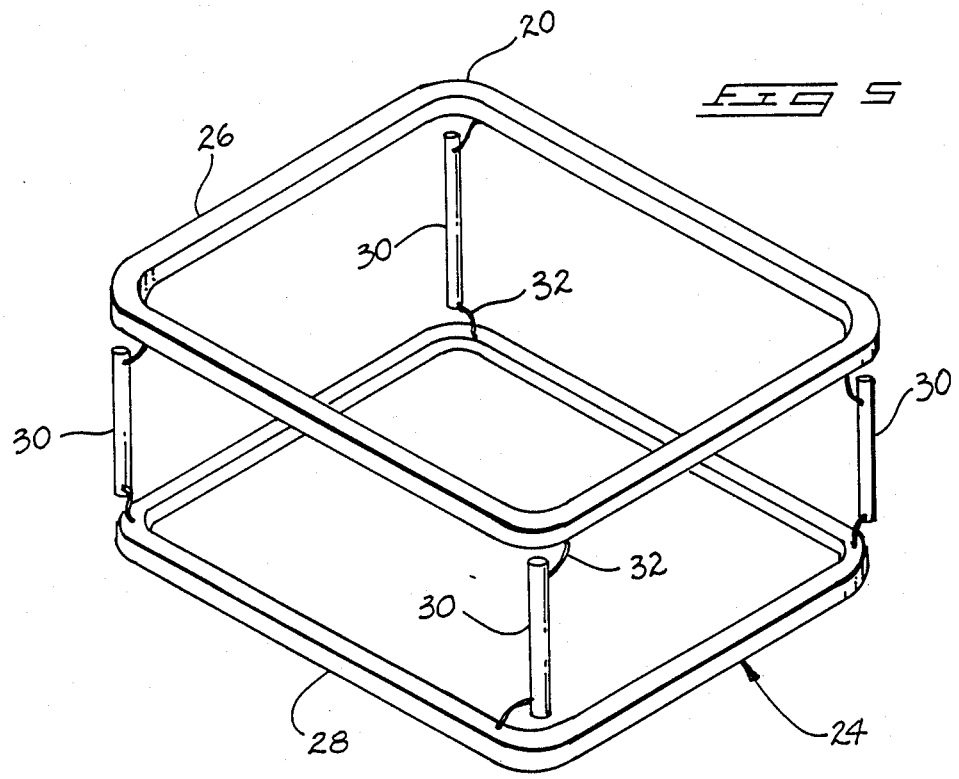
FIG. 5 is a perspective view of the rigid frame structure used in the combination of the present invention.
Figure 6:
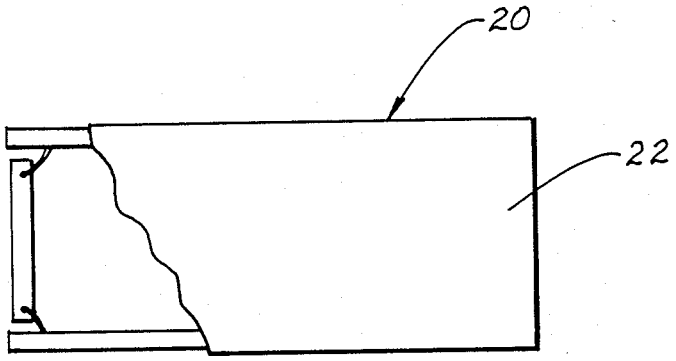
FIG. 6 is a partial side-elevation view of the frame structure in combination with a flexible wall portion of the container.

FIGS. 5 and 6 of the drawings are illustrative of a rectangularly shaped bowl which is generally designated by the reference numeral 20. Recognizing the fact that a bowl 20 must be manufactured from a flexible liner 22 having a captured refrigerant holding chamber (analogous to the fluid holding chamber 18 of FIG. 4) therein, thus to accommodate expansion of the bowl during a freezing of the refrigerant, it can be appreciated that some means must be provided for causing the bowl to retain its food holding shape. This is accomplished through the use of an enclosed rigid frame structure 24.

The frame structure 24, which is retained within the fluid holding chamber (not shown in FIGS. 5 or 6, but analogous to the fluid holding chamber 18 of FIG. 4), includes a top rigid edge or rim member 26 and a similarly shaped bottom edge or rim member 28. To prevent the rim members 26, 28 from collapsing onto one another, thus to destroy the food retaining shape of the bowl 20, a plurality of upstanding vertical supports 30 are positioned between the members. The upstanding members 30 are attached between the rim members 26, 28 by small flexibly movable tabs 32 which are not rupturable as a result of the freezing of the refrigerant. However, the tabs 32 do permit a relatively movable attachment of the support members 30 between the rim members 26, 28 to thus allow relative movement between the rim members during a freezing of the captured refrigerant. By the same token, the flexible tabs 32 serve to support the upstanding members 30 in a substantially vertical position to thus prevent container wall collapse.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A chillable food holding container, comprising:

a. wall means formed from a flexible and expandable material;

b. refrigerant holding chamber means formed in said wall means; and, c. rigid frame structure retained within said refrigerant holding chamber means for causing said container to maintain its food holding shape when said refrigerant is in a liquid state, said rigid frame structure including upper and lower rims for defining upper and lower edges of said container.

2. The chillable food holding container of claim 1, and further including substantially vertical supports positioned between said upper and lower rims, thereby to facilitate a retention of said food holding shape of said container.

3. The chillable food holding container of claim 2, wherein said upper and lower rims are relatively movable with respect to one another.

4. The chillable food holding container of claim 3, wherein said substantially vertical supports are relatively movable with respect to said upper and lower rims.

5. The chillable food holding container of claim 4, wherein said substantially vertical supports are attached to said upper and lower rims by small flexible tabs.

* * * * *